US006234093B1

(12) United States Patent
Finker et al.

(10) Patent No.: US 6,234,093 B1
(45) Date of Patent: May 22, 2001

(54) FURNACE

(75) Inventors: Felix Zalmanovich Finker; Igor Borisovich Kubishkin; Vitali Yurievich Zakharov, all of S. Petersburg (RU); Czeslaw Sobczuk; Jan Swirski, both of Warszawa (PL)

(73) Assignee: Polytechenergo, St. Petersburg (RU)

( * ) Notice: Subject to any disclaimer, the term of this patent is extended or adjusted under 35 U.S.C. 154(b) by 0 days.

(21) Appl. No.: 09/051,596

(22) PCT Filed: Aug. 15, 1997

(86) PCT No.: PCT/RU97/00258

§ 371 Date: Sep. 2, 1998

§ 102(e) Date: Sep. 2, 1998

(87) PCT Pub. No.: WO98/06976

PCT Pub. Date: Feb. 19, 1998

(30) Foreign Application Priority Data

Aug. 15, 1996 (RU) ..... 96117030

(51) Int. Cl.[7] ..... F23C 1/00; F23C 3/00; F23C 7/00

(52) U.S. Cl. ..... 110/266; 110/297; 110/232; 110/261; 110/347

(58) Field of Search ..... 110/203, 215, 110/232, 260, 261, 263, 264, 266, 297, 342, 345, 347; 431/4

(56) References Cited

U.S. PATENT DOCUMENTS

| | | | | |
|---|---|---|---|---|
| 4,246,953 | | 1/1981 | Mehta . | |
| 4,308,806 | | 1/1982 | Uemura et al. . | |
| 4,501,204 | | 2/1985 | McCartney et al. . | |
| 4,655,148 | | 4/1987 | Winship . | |
| 4,715,301 | | 12/1987 | Bianca et al. . | |
| 4,831,942 | * | 5/1989 | Morimoto et al. | 110/347 X |
| 4,854,249 | | 8/1989 | Khinkis et al. . | |
| 4,878,442 | * | 11/1989 | Yeh et al. | 110/347 X |
| 4,993,332 | | 2/1991 | Boross et al. . | |
| 5,199,357 | | 4/1993 | Garcia-Mallol . | |
| 5,495,813 | | 3/1996 | Chapman et al. . | |
| 5,769,008 | * | 6/1998 | Finker et al. | 110/347 X |

FOREIGN PATENT DOCUMENTS

| | | |
|---|---|---|
| 1 279 276 | 10/1968 | (DE) . |
| 1115447 | 8/1965 | (GB) . |
| 4-67085 | 10/1992 | (JP) . |
| 483559 | 5/1973 | (SU) . |
| 1638449 A1 | 4/1989 | (SU) . |
| 1588986 A2 | 7/1989 | (SU) . |

* cited by examiner

*Primary Examiner*—Ira S. Lazarus
*Assistant Examiner*—Ljiljana V. Ciric
(74) *Attorney, Agent, or Firm*—Fay, Sharpe, Fagan, Minnich & McKee, LLP

(57) ABSTRACT

A furnace is provided for burning soila organic fuels including highly volatile organic fuels. A combustion chamber with an ash hopper has a slot mouth opening defined by slopes of the walls of the combustion chamber. A burner is disposed beneath the ash hopper mouth opening and extends across its entire width. A bottom blast inlet device generates a turbulent zone in the lower region of the combustion chamber. A duct is further provided for injecting a sulfur-absorbent material into the furnace chamber. The duct is disposed between the burner and the ash chamber and defines a longitudinal axis which traverses the turbulent zone. Preferably, the burner is tilted downwardly and is disposed on a wall in common with the sulfur-absorbent induction duct. The proportion of the sulfur-absorbent materials in the fuel mixture is in the range of 10% to 100% by mass.

5 Claims, 3 Drawing Sheets

FURNACE

FIELD OF THE INVENTION

The invention relates to heat engineering and more particularly, to furnaces for burning organic fuel. It can be most successfully used for burning solid sulphur-bearing, ie. high-volatile, fuel.

BACKGROUND OF THE INVENTION

As furnaces are designed, a special emphasis is laid on their environmental protection features and specifically, on the furnaces being capable of providing combustion regimes that would minimize the amount of furnace compounds vented to the atmosphere.

The nitrogen oxide content of flue gases may be reduced, directly as the fuel is burned, by proper arrangement of the combustion process, i.e. using comparatively simple and economical methods, without the necessity to resort to a complex, bulky and expensive auxiliary equipment. Thus, according to the latest views, a reduced concentration of nitrogen oxides in combustion products may be achieved by an optimum arrangement of three major zones in the flame, namely: ignition and active-combustion zone, reduction zone and oxidation (reburning) zone.

Known in the art (see USSR Author's Certificate No.483559) is a furnace comprising a combustion chamber with a burner for supplying the fuel-air mixture mounted on its sidewall. The slopes of the walls in the lower region of the combustion chamber define a V-type ash hopper with a slot-like mouth. A bottom blast device formed by, say, an air nozzle is disposed beneath the ash hopper mouth.

During operation of such furnace, a fuel-air mixture with a less-than-unity excess-air coefficient is supplied through the burner, while from beneath, through the slot mouth, part of the air necessary for fuel combustion is supplied by the bottom blast device. As a result of interaction between two mutually opposing flows, a turbulent zone is formed throughout the lower region of the furnace, whereas a parallel-flow zone is formed in the upper region thereof. An ignition and active-combustion zone is located adjacent the burner. It is within this combustion zone that the bulk of the fine particles of the fuel is burnt out. The medium-sized and coarse particles of the fuel are separated into the turbulent zone. In the turbulent zone, these particles are burnt out in the course of recycling, After burning down to a certain size, they are removed beyond, the turbulent zone and finally burnt in the upper - parallel-flow - part of the flame. A major portion of the turbulent zone is characterized by a relative deficiency in oxygen and serves as a reduction zone, while the oxygen-rich parallel-flow zone serves as a reburning zone. In other words, a ste-by-step burning of the fuel is conducted in such furnace.

Thus, through the arrangement of the above combustion zones in the furnace by controlling the supply of the fuel of a particular fraction composition and by selecting an appropriate bottom blast rate, a fairly small nitrogen oxide content of flue gases may be ensured.

The above mentioned features of a vortex furnace, however, fail to provide a reduction of the sulphur oxide content of flue gases, since it is virtual impossible to achieve this end using purely aerodynamic and structural techniques.

Special problems arise when burning high-volatile organic fuels. This is due to the fact that as such fuel is heated, an excessive amount of explosive gases is released in the pulverization system, so that a special care is required when selecting the proper scheme of the pulverization process and supplying said fuel to the combustion chamber. Specifically, furnace (inert) gases, rather than air (containing much oxygen), are generally used for drying such fuels.

Known in the art is a furnace for burning solid organic fuel described in the book: R. G. Sach "Boiler Plants" Energy, Moscow, 1968, p.77, comprising a prism-shaped furnace chamber with at least one burner mounted on its wall. The furnace is equipped with a fuel chute serving to supply the fuel to a vertical gas-intake shaft. The gas-intake shaft communicates at the top through a gas-intake window, by a special duct, with the inner space of the furnace chamber. The gas-intake window is generally disposed in the upper region of the furnace chamber. The lower end of the gas-intake shaft communicates with a pulverizing fan for grinding the fuel. The pulverizing fan in turn communicates with a burner for supplying fuel to the furnace chamber.

As the furnace is operated, the flue gases from the top of the combustion chamber are fed through the gas-intake window and the special duct to the gas-intake shaft in which the fuel supplied from the chute is predried and otherwise prepared, by the action of the high temperature of these gases. In this case, there occurs a partial release from the fuel of volatile matter which is mixed with oxygen-deficient inert flue gases. The prepared fuel is transferred to the pulverizer where it is ground to the required fineness and then finally dried. The fuel, along with the gas mixture, is then supplied through the burner to the furnace chamber wherein it is burned together with the volatile matter that had been released before. Since the release of volatile matter from the fuel, as it is passed through the gas-intake shaft, occurs in the flue gas atmosphere having a relatively small concentration of oxygen, no explosive volatile-and-oxygen mixture can be formed under these conditions, thus preventing the risk of explosions and providing the safety of the fuel pulverization system and the furnace itself.

This furnace is rather cost-effective, since effluent gases may be partially used for fuel preparation and drying, and also it may be regarded as environment-friendly, because a complete fuel combustion is ensured at comparatively low temperatures, but provided it is a low-sulphur fuel. Otherwise, this furnace would require additional measures to minimize the sulphur oxide content of the exit gases.

Currently, three basic schemes are largely employed to minimize the amount of sulphur in the flue gas: either sulphur is removed from the fuel prior to feeding it to the furnace (generally, at the spot where it is produced), or various calcium- and magnesium-bearing absorbents, such as lime, calcium carbide etc., are used for cleaning the flue gas beyond the boiler or, finally these absorbents are immediately injected into the furnace chamber for direct (dry or semi-dry) binding the sulphur. Besides, there are composite schemes of binding the sulphur contained in organic fuel. Since calcium compounds belong to low-melting substances, it is essential to feed the absorbent particles to those regions of the furnace in which the temperature does no exceed the absorbent melting point: otherwise, the absorbent particle surface would be fused with the consequent clogging of the pores and reduced reaction area . This might result in a less economical operation of the furnace due to the slagging of water walls and even in a complete shutdown of the boiler.

Known in the art is a furnace realizing a method of simultaneous removal of sulphur and nitrogen from the combustion products. The method is disclosed in the Japanese Patent No. 4-67085.

The furnace comprises a combustion chamber with at least one burner mounted on its wall for supplying the air-fuel mixture. The furnace is provided with an absorbent-feeding means represening a duct for supplying the furnace with finely dispersed or slurry-like calcium-bearing substances for binding sulphur-bearing compounds, which lies above the burner level on the same wall. In addition, the design provides a special equipment for recovery of fly ash from the fuel combustion products, special treatment of this ash and its return to the combustion zone for recycling.

As such furnace is operated, the air-fuel mixture is supplied to the combustion chamber through the burner and the sulphur-absorbing agent is conveyed through an appropriate duct. The absorbent is received by the combustion chamber at a temperature within the range of 900 to 1200° C. In close proximity to the absorbent-feeding duct, a sulphur-binding reaction occurs. The gaseous combustion products then enter the smoke flue with a special device provided therein for the recovery of fly ash, followed by adding acid to part of the ash recovered to neutralize the unreacted calcium oxide or carbonate, and this ash then goes to waste. Ammonium or urea (or its compounds) is added to the remaining part of the ash and the ash is returned to the furnace, to a region with temperatures ranging from 500 to 1000 ° disposed at the outlet of the combustion chamber (already beyond its limits). In this region, an additional simultaneous binding of sulphur and, partially nitrogen (out of oxides) occurs.

In this furnace, combustion is carried out within the parallel-flow zone, which accounts for a relatively small residence time of the fuel and absorbent particles within the combustion chamber and hence, a short time of interaction between the absorbent and the flue gases. In these conditions, an effective binding of sulphur is only possible if both the fuel and the absorbent have been subjected to a thorough preparation and its uniform, finely dispersed, structure ensured. Again, the thorough pulverization of the absorbent is also required to obtain its maximum surface area and hence, its full utilization, because the sulphur-binding reaction takes place, largely, on the surface. For such reaction to proceed over the entire surface of an absorbent particle takes more time than the period during which the particle stays within a temperature zone most favourable in terms of the sulphur-binding reaction conditions, namely: 600 . . . 1100° C. Furthermore, in the presence of coarse particles of both the fuel and the absorbent, these particles will not be carried from the furnace entrained in the flue gas but will rather fall through the mouth at the bottom of the combustion chamber and be removed along with the slag, with the consequently impaired economical and environmental-control performance of such furnace. Even a thorough preparation of the absorbing material, however, fails to provide such degree of pulverization that all the absorbent particles react to the full with the sulphur oxides. There always is a certain amount of relatively coarser particles having a layer of reacted absorbent formed on their surface, while the core portion does not take part in the sulphur-binding reaction. This leads to an increased consumption of the expensive absorbent and a lower economical and ecological performance of the furnace. In addition, a complicated system of the post-cleaning of gases after the boiler also results in higher production costs.

DISCLOSURE OF THE INVENTION

The aim of the present invention is to provide a furnace design such that it allows the use of a sulphur-absorbing material and a fuel of comparatively large-sized fraction composition, thereby reducing the expenses for their preparation, and an essentially complete utilization of the absorbent at an optimum temperature to permit the binding of sulphur oxide compounds, thus improving the cost-effectiveness and environmental control of the furnace and further, when using a high-volatile sulphur-bearing fuel, such design as to provide a safe concentration of volatile matter within the combustion chamber and hence, a more reliable furnace.

This aim is achieved by providing that in a furnace for burning solid organic fuel comprising a prism-shaped combustion chamber with an ash hopper having a slot mouth defined by the sloping walls in the lower region of the combustion chamber, at least one burner mounted on its wall, and a duct for injecting a sulphur absorbing agent into the furnace chamber, according to the invention, a bottom blast inlet device is disposed beneath the mouth of the ash hopper across its entire width for generation of a turbulent zone in the lower region of the combustion chamber, the absorbent is supplied to the furnace chamber mixed with the fuel, and the absorbent-injection duct is disposed at an elevation not above the burner and so directed that its longitudinal axis traverses the turbulent zone.

By virtue of the bottom blast inlet means being disposed over the entire width of the ash hopper mouth, a turbulent zone is generated in the lower region of the combustion chamber as a result of interaction between two opposing streams, i.e. the air-fuel mixture from the downward-tilting burner and air from the bottom blast nozzle extending along the slope of the ash hopper. Owing to the arrangement of the absorbent-injection duct not above the burner level and due to its direction as hereinbefore mentioned, both the fuel and the absorbent are supplied to the turbulent zone. In the turbulent zones, both these streams are mixed and favourable sulphur-binding conditions arise. By supplying the absorbent mixed with the fuel, a uniform distribution of the absorbent particles throughout the turbulent zone is achieved.

Relatively low temperatures (about 1000° C.) present in the turbulent zone provide, in the first place, optimum conditions for binding the sulphur, since at these temperatures, the rate of the direct reaction between calcium oxide and sulphur dioxide exceeds the reverse calcium sulphate decomposition reaction rate. Secondly, no fusion of the absorbent particle surfaces occurs and consequently, no clogging of the pores and reduction of the reaction surface is observed. A calcium sulphate layer formed on the surface of an absorbent particle and continually growing with time remains unfused and porous, enabling the sulphur oxide to penetrate along the cracks and pores and find its way to the so-far unreacted surface of the absorbent. Thirdly, due to recycling the particles in the turbulent zone, there is a sharp increase in the residence time of particles within the favourable temperature zone and consequently, in the reaction time and the degree of binding the sulphur.

A possible fusion of absorbent particles may only occur as they are conveyed from the turbulent zone to the parallel-flow (high temperature) one of the furnace. In this design, however the sulphur oxide binding effect is not much influenced by this circumstance since, firstly, the absorbent particles have already "done the job" in the turbulent zone, and it is not the active calcium oxide layer that may be fused, but rather a layer of the reaction product, i.e. calcium sulphate. Secondly, the residence time of an absorbent particle within the unfavourable, i.e. parallel-flow, zone is much shorter than the residence time within the favourable turbulent zone.

It goes without saying that the coarse particles of the absorbent react the longest and the coarse particles of the fuel burn the slowest. In the proposed device, however, the largest pieces both of the fuel and the absorbent are separated into the lower region of the combustion chamber, where they are entrained in the air stream leaving the bottom blast nozzle and are returned to the turbulent zone. Thus their residence time within the favourable temperature zone is sharply increased. Moreover, the residence time of the fuel and absorbent particles within the turbulent zone and hence, the sulphur absorption reaction time may be controlled, depending on the fuel characteristics, by decreasing or increasing the bottom blast rate.

It will be noted that in the proposed furnace, due to the presence of a turbulent zone, the nitrogen oxide content of flue gases is reduced, similarly to what was described above in connection with the known device.

The burner for supplying the air-fuel mixture may be tilted downwards, the absorbent-injection duct disposed on the same wall as the burner and directed in such a manner as to ensure that the angle formed by the longitudinal axis of the absorbent-injection duct and a projection of this axis onto this wall is no less than the angle formed by the sloped wall of the combustion chamber and a vertical line lying on this wall, and no greater than the angle formed by the longitudinal axis of the burner and a projection of this axis onto the same wall of the combustion chamber. In this case, the stream of the absorbent supplied to the combustion chamber is received, predominantly, by the central portion of the turbulent zone, thereby providing the most thorough mixing of the absorbent and the fuel and their most effective interaction.

The absorbent-injection duct may be located in the outlet nozzle of the botton blast device, whereby the furnace design is somewhat simplified.

The proportion of the absorbent in the mixture may range from 10 to 100% by mass, depending on the sulphur content of the fuel.

The furnace may further include a gas-intake shaft, a duct for supplying the absorbent to the gas-intake shaft, and a pulverizing fan, all communicating with one another, the pulverizing fan communicating in turn with the burner, the duct for injection of the absorbent into the furnace chamber being aligned with said burner.

In this case, the sulphur-compound binding absorbent is supplied via a special absorbent-injectlon duct to the upper region of the gas-intake shaft, wherein the absorbent particles react with the sulphur compounds contained in the flue gases extracted from the conbustlon chamber through the gas-intake shaft. A layer of reacted absorbent is then formed on the surface of the absorbent particles. Because the absorbent, along with the fuel, is transported from the gas-intake shaft to the pulvenzer, this layer is destroyed and the absorbent particles are mixed with the fuel. Subsequently, as the fuel mixed with the absorbent is supplied to the combustion chamber via the absorbent-injection duct aligned with the burner, there occurs a further interaction between the unreacted absorbent particles and the sulphur compounds.

So in this case, the absorbing agent is used twice: within the gas-intake shaft and within the combustion chamber, thereby ensuring its essentially complete utilization and hence, high economical and environmental performance of the proposed furnace.

The use of flue gases for preparation and drying of a high-volatile fuel by feeding it to the gas-intake shaft and subsequent preparation of this fuel by means of a pulverizing fan is virtually known in itself. The authors, however, are not familiar with furnaces wherein the absorbent is supplied to the upper region of the gas-intake shaft and used for binding the sulphur compounds twice: first, in the gas-intake shaft, and then within the combustion chamber.

BRIEF DESCRIPTION OF THE DRAWING

The invention is now illustrated by the accompanying drawing in which.

DESCRIPTION OF PREFERRED EMBODIMENT OF THE INVENTION

Figure 1:
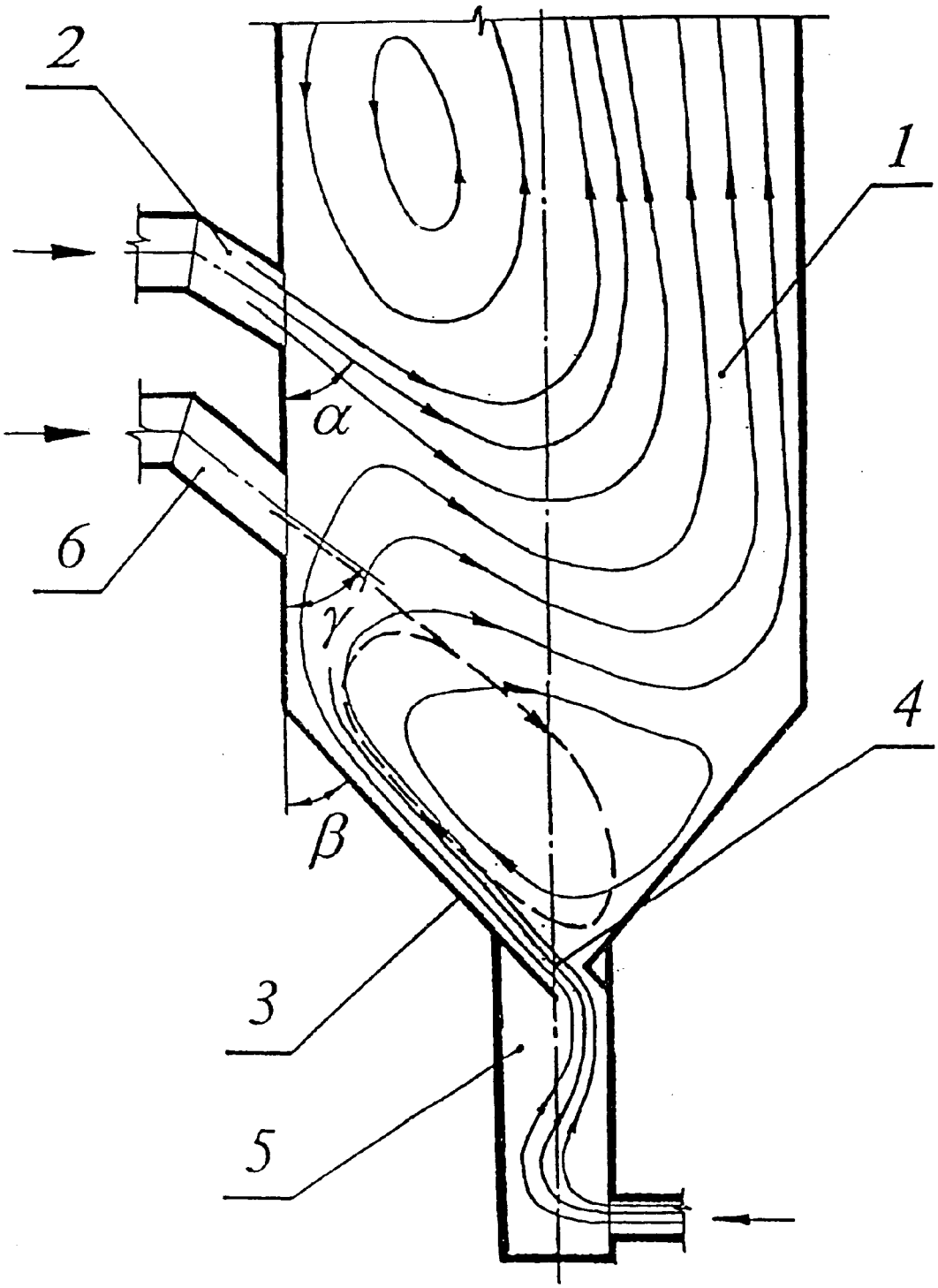
FIG. 1 is a schematic representation of a furnace for burning a solid organic fuel, a sectional elevational view.

Referring now to FIG. 1, the furnace comprises a combustion chamber 1 with a downwardly tilting burner 2 for supplying the air-fuel mixture mounted on its wall. The angle of the longiltudinal axis of the burner 2 with a projection of this axis onto the wall is denoted by $\alpha$ in FIG. 1. A prism-shaped ash-hopper with a slot mouth 4 is defined by slopes 3 of the walls in the lower region of the combustion chamber 1. The angle of the slope 3 with the vertical line is denoted by $\beta$ in FIG. 1. Disposed beneath the ash hopper mouth 4, over the entire width thereof, is a bottom blast device 5 used to generate a turbulent zone in the lower region of the combustion chamber 1. A duct 6 for injection of a calcium-bearing absorbent region of the combustion chamber 1. A duct 6 for injection of a calcium-bearing absorbent such as lime or calcium carbonate mixed with fuel is located below the burner 2. The longitudinal axis of the duct 6 is tilted downwardly, the angle made by the longitudinal axis of the duct 6 with a projection of this axis onto the wall of the combustion chamber being denoted by $\gamma$ in the drawing. The absorbent-injection duct may also be disposed at the same elevation as the burner for supplying the air-fuel mixture. In both cases, the absorbent-injection duct 6 is preferably positioned so that slope y of the longitudinal axis of the absorbent-injection duct 6 is no less than the angle $\beta$ made by the slope 3 of the combustion chamber walls defining the ash hopper and no greater than angle $\alpha$ made by the longitudinal axis of the burner 2. In this case, the axis of the absorbent-injection duct 6 is passed through the lower region of the combustion chamber, crossing the central portion of the turbulent zone.

Figure 2:
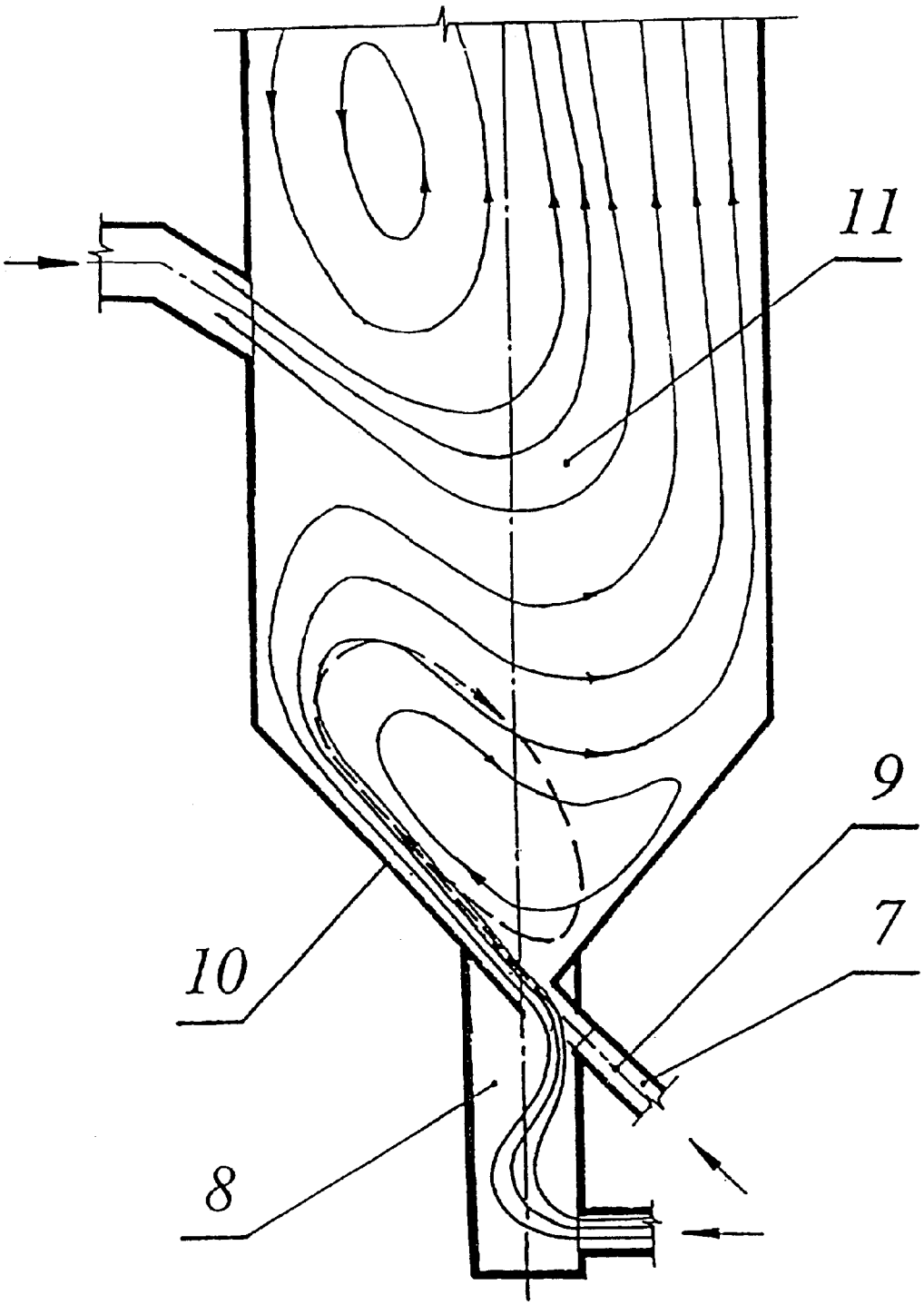
FIG. 2 is a schematic sectional elevational view of the furnace, in accordance with another embodiment of the invention.

FIG. 2 shows another embodiment of the invention. Referring to FIG. 2, an absorbent-injection duct 7 is disposed in the outlet nozzle of a bottom blast device 8. In this case, the axis of the duct 7 runs along a slope 10 of a combustion chamber 11, crossing the lower region of the chamber and hence, the turbulent zone.

When such furnace is operated, as shown in FIG. 1, the air-fuel mixture is supplied through the burner 2, air is introduced through the bottom blast device, and a calcium-bearing absorbent, generally, lime or calcium carbonate mixed with fuel is supplied through the absorbent-injection duct 6. As a result of interaction between air-fuel mixture streams, fuel-absorbent mixture and bottom blast air, two major combustion zones are generated in the furnace chamber, namely: parallel-flow and turbulent zones. The composition of the fuel-absorbent mixture selected is dependent on the characteristics of the fuel and the absorbent. The fraction of the absorbent in the total mass ranges from 10 to 100% and is chosen from considerations of the best possible binding of sulphur and the most economical expenditure of the absorbent.

Fine particles of the absorbent are ignited near the burner and burned within the parallel-flow part of the flame. Simultaneously, fine particles of the absorbent are entrained in the upgoing airstreams from the bottom blast device and also carried over to the parallel-flow part of the flame, wherein they interact with the fuel particles to bind sulphur.

Medium-sized and coarse particles of the fuel and absorbent are separated into the turbulent zone. In this zone, the fuel particles are burnt out in the course of repeated recycling. Absorbent particles are recycled in the turbulent zone along with the fuel particles. As a consequence of a repeated recycling of the particles and a long residence time within a zone being at a temperature most favourable in terms of the sulphur-binding reaction conditions, this reaction proceeds more vigorously. This is facilitated by a good mixing of absorbent particles and flue gases in the turbulent zone. As the fuel particles are recycled in the turbulent zone, they are burned out, become lighter and are carried to the parallel-flow zone and then, already as fly ash and flue gas, vented to the smoke stack. During recycling in the turbulent zone, the absorbent particles are mechanically destroyed as a result of impacting the fuel particles and the combustion chamber walls, though still participating in the sulphur-binding reactions. The fine particles of the absorbent that is, generally, already utilized, i.e. bound with sulphur are entrained in the upgoing streams and carried over to the parallel-flow zone of the furnace, and then to the smoke stack.

Figure 3:
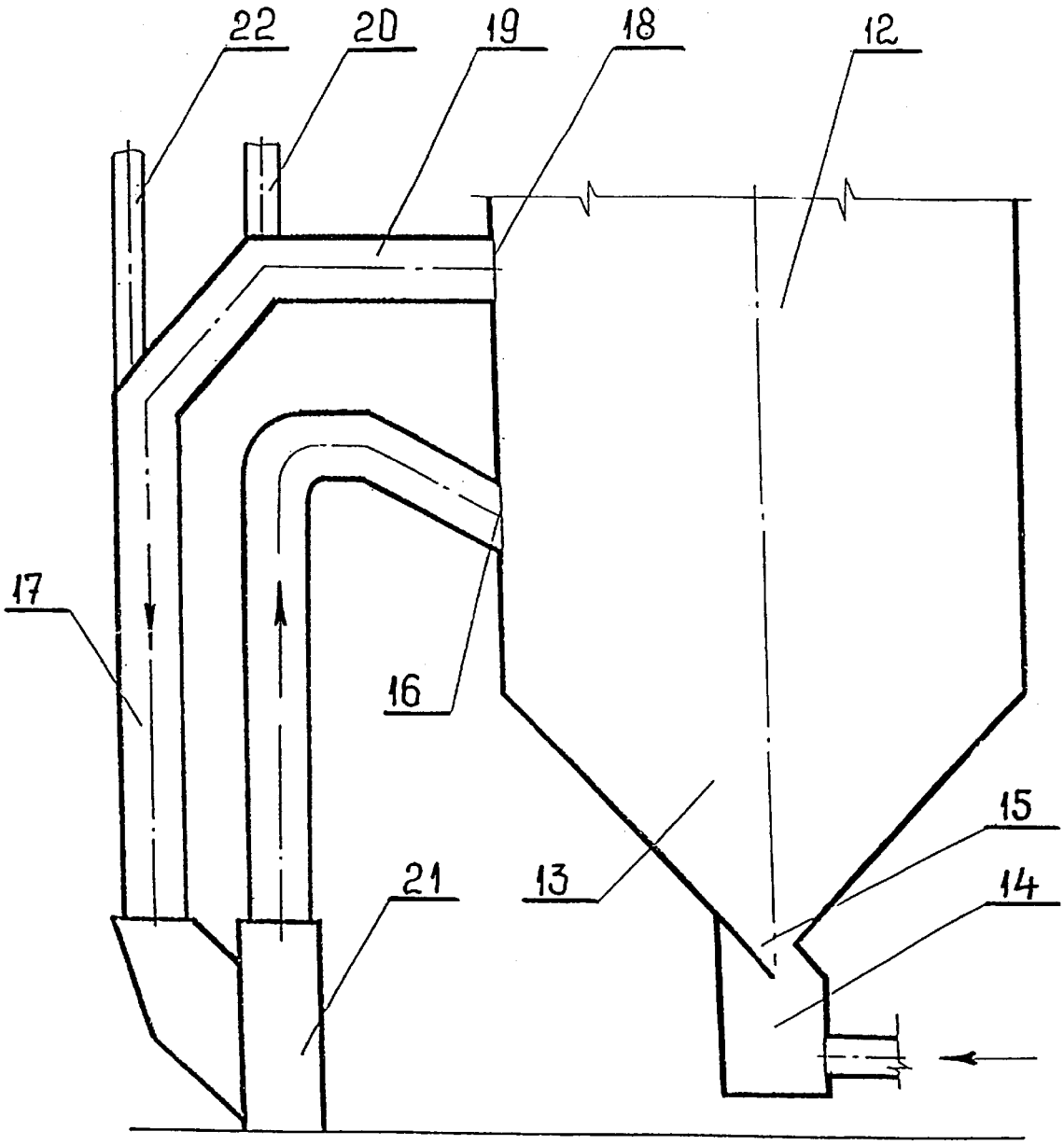
FIG. 3 is a schematic sectional elevational view of the furnace, in accordance with a third enbodiment of the invention.

The furnace of FIG. 2 operates in a similar manner, except that both fine and relatively coarse particles of the absorbent are received by the turbulent zone via the duct 7. The fine particles are carried to the parallel-flow zone, whereas the coarse and medium-sized particles, similarly to the previous design are recycled within the turbulent zone, reacting with absorbing material sulphur Referring to FIG. 3, the furnace comprises a prism-shaped combustion chamber 12 with an ash hopper 13 defined by the slopes of the walls in the lower region of the combustion chamber, and a botton blast inlet device 14 extending along the entire width of a slot mouth 15 of the ash honper 13. The furnace further includes a burner 16 mounted on its wall and a vertically elongated gas-intake shaft 17. The gas-intake shaft 17 communicates at the top with the inner space of the combustion chamber 12 through a gas-intake window 18 and a duct 19. The duct 19 communicates in turn with an absorbent-feeding duct 20. The lower region of the gas-intake shaft 17 communicates with a pulverizing fan 21 and then, through the burner 16, with the inner space of the combustion chamber 12. The duct (not shown in the drawing) for injection of the absorbent into the furnace chamber is aligned with the burner.

As the furnace is operated, the fuel is fed through a chute 22 to the gas-intake shaft 17. At the same time, hot flue gases are admitted through the gas-intake window 18 to the duct 19 and then to the gas-intake shaft 17, the flue gases being premixed with the sulphur-compound binding absorbent conveyed through the duct 20 to the duct 19. As the flue gases and the absorbent and fuel particles pass along the gas-intake shaft 17, the fuel is heated, the volatile matter released and mixed with the flue gases. Simultaneously, a reaction of binding the sulphur compounds with the absorbent proceeds on the surface of the absorbent particles. Since the flue gases are at a temperature ranging from 600 to 1100° C., which is known to be the most favourable temperature range for such sulphur-binding reaction to be effective, optimum conditions for binding the sulphur compounds are ensured in the gas-intake shaft 17. The fuel mixed with gas and absorbent is transferred from the gas-intake shaft 17 to the pulverizing fan 21. In the pulverizing fan 21, the fuel is further dried, its particles and the particles of the absorbent are pulverized and mixed. In the course of this treatment, the surface layer of the absorbent particles is destroyed and the so-far unreacted core of these particles now becomes accessible. Thus the absorbent particles are ready for reuse. The prepared mixture is fed to the burner 16. The fine particles of the fuel and the volatile matter burn in the vicinity of the burner, within the parallel-flow part of the flame. The coarser, solid, particles of the fuel and the absorbent go down to the lower region of the furnace and are entrained in the air stream coming from the bottom blast inlet 14 and directed along the slope of the ash hopper. The opposite streams of the air mire from the burner and the air supplied by the bottom blast inlet device interact to generate a turbulent zone having a temperature of about 1000° C. A repeated recycling of the fuel and absorbent particles and the flue gases within this zone allows their long residence at a temperature which is most effective for binding the sulphur, thereby ensuring an essentially complete utilization of the absorbent.

Investigations made by the authors have shown that the proposed furnace provides a substantially reduced sulphur oxide content of the flue gases along with an economical use of the absorbent. In addition, such filnace is safe to operate even if a high-volatile fuel is used. The proposed furnace is so designed as to allow the use of the fuel and the absorbent material of a relatively large-sized fraction composition, causing the expenses involved in their preparation to be somewhat reduced. Furthermore, owing to the advantages inherent in the swirling type fiurnaces with a repeated recycling of particles in the furnace chamber, an essentially complete utilization of the absorbent is ensured, resulting in a still more cost-effective operation of the furnace.

The proposed invention can be employed in designing new furnaces as well as in the overhaul of existing boiler units equipped with furnaces using as fuel bituminous coals and lignites with a sulphur content of more than 1%, as-received basis.

The proposed invention was realized in overhauling a furnace of a power-generating boiler using as fuel a coal dust with the lowest combustion heat of 4500 to 5000 kcal/kg and a sulphur content of 1.0 to 1.5%, as-received basis. The furnace includes four burners disposed each on one of the four walls of the furnace. Each burner is designed as an arrangement of three overlying ducts. Located below each of the burners is one duct for injection of the absorbent mixed with the fuel in the proportion of about 50% by mass. The angle made by the longitudinal axis of the upper duct of each burner with a projection of this axis onto the vertical wall of the combustion chamber was 80 deg., the angle made by the longitudinal axis of the middle duct of each burner with a projection of this axis onto the vertical wall of the combustion chamber was 70 deg, and the angle made by the longitudinal axis of the lower duct of each burner with a projection of this axis onto the vertical wall of the combustion chamber was 60 deg. The angle of the longitudinal axis of the absorbent-injection duct with a projection of this axis onto the vertical wall of the combustion chamber was 35 deg. The amount of sulphur oxides vented to the atmosphere was reduced, after the overhaul by some 40 to 50%.

What is claimed is:

1. A furnace comprising:

a prism-shaded combustion chamber with an ash hopper having a slot mouth defined by sloping walls of the combustion chamber in a lower region of the combustion chamber;

at least one burner mounted on one of said walls of the combustion chamber for injecting a solid organic fuel into the combustion chamber;

a duct for injecting a sulfur-absorbing material into the combustion chamber; and, a bottom blast inlet device disposed adjacent the slot mouth of the ash hopper and across an entire width of the ash hopper for generating a turbulent zone in lower region of the combustion chamber, the duct being located between the burner and the ash hopper and being oriented in such a manner that a longitudinal axis defined by the duct is directed towards the turbulent zone.

2. The furnace according to claim 1 wherein the burner for feeding the air-fuel mixture is tilted downwardly, the absorbent-injection duct is disposed on the same wall as the burner, an angle $\gamma$ made by the longitudinal axis of the absorbent-injection duct with a projection of the longitudinal axis onto said same wall is no less than an angle $\beta$ made by a sloping wall of the combustion chamber with the vertical lying on said same wall and no greater than an angel $\alpha$ made by the longitudinal axis of the burner with a projection of the longitudinal axis onto said same wall of the combustion chamber.

3. The furnace according to claim 1 further including an absorbent-injection duct disposed in the outlet nozzle of a bottom blast device.

4. The furnace according to claim 1 wherein the furnace is adapted to burn said solid organic fuel as a mixture with said sulfur-absorbing material, where a proportion of the sulfur-absorbing material in the mixture ranges from 10% to 100% by mass.

5. The furnace according to claim 1 further including:

a gas-intake shaft;

a duct for feeding the sulfur-absorbing material into the gas-intake shaft; and, a pulverizing fan communicating the sulfur-absorbing material from the duct to said at least one burner.

* * * * *